United States Patent [19]

Kassai

[11] Patent Number: 4,499,619

[45] Date of Patent: Feb. 19, 1985

[54] BABY BED

[75] Inventor: Kenzou Kassai, Osaka, Japan

[73] Assignee: Kassai Kabushikikaisha, Osaka, Japan

[21] Appl. No.: 478,336

[22] Filed: Mar. 24, 1983

[30] Foreign Application Priority Data

Apr. 9, 1982 [JP] Japan ..... 57-60124

[51] Int. Cl.[3] ..... A47C 29/00; A47D 7/00

[52] U.S. Cl. ..... 5/99 A; 5/98 B; 5/93 R; 16/370; 16/360; 403/95

[58] Field of Search ..... 5/93 R, 98 R, 98 B, 5/99 R, 99 A, 110, 111; 403/95, 100; 16/370, 347, 348, 360

[56] References Cited

U.S. PATENT DOCUMENTS

| | | | |
|---|---|---|---|
| 1,266,927 | 5/1918 | Eberle | 5/101 |
| 3,049,727 | 8/1962 | Ruddy | 5/99 R |
| 3,063,065 | 11/1962 | Shaw | 5/99 R |
| 3,092,847 | 6/1963 | De Puy | 5/98 R |
| 3,119,124 | 1/1964 | Krauss | 5/99 R |
| 3,158,876 | 12/1964 | Gottlieb | 5/99 R |
| 3,309,718 | 3/1967 | Sarasin | 5/98 R |
| 3,474,472 | 10/1969 | Hamilton | 5/98 R |

*Primary Examiner*—Alexander Grosz
*Assistant Examiner*—Michael F. Trettel
*Attorney, Agent, or Firm*—W. G. Fasse; D. H. Kane, Jr.

[57] ABSTRACT

A baby bed includes front and rear frames (2, 3), a hammock (4) suspended from the front and rear frames (2, 3), front and rear legs (5, 6), and base blocks (7, 8) adapted to rotatably support the front and rear frames (2, 3) and the front and rear legs (5, 6). Brackets (13, 15) are rotatably attached to the front and rear legs (5, 6), respectively, and the brackets (13, 15) are rotatably connected by a guide pin (16) vertically movable along a guide slot (17) formed in at least one of the base blocks (7, 8). The front and rear frames (2, 3) are connected to the front and rear brackets (13, 15) through links (19, 23), respectively. A handle (26) having a locking recess (26c) is rotatably connected to the guide pin (16). When the locking recess (26c) is engaged by the engaging pin (27) fixed to the base block (7), upward movement of the guide pin (16) is prevented, whereby the baby bed is locked in its open state. When the engaging pin (27) is brought out of engagement in the locking recess (26c) and the front and rear frames (2, 3) are rotated downwardly, the guide pin (16) is moved upwardly to thereby make the baby bed collapsible.

9 Claims, 7 Drawing Figures

BABY BED

BACKGROUND OF THE INVENTION

1. Field of the Invention

This invention relates to a baby bed and more particularly to improvements in a folding mechanism of a collapsible baby bed.

2. Description of the Prior Art

In recent years there have been developed various types of baby beds. One type of prior art baby bed cannot be folded and hence occupies a good deal of useless space when not in use. Storing such a bed in a limited space is also not possible. Accordingly, a baby bed of the type which can be folded into a compact shape when not in use is gaining in popularity, and a variety of foldable bed assemblies have heretofore been proposed. However, they still left much to be desired in that some of them caused users much trouble in the folding operation and others were not foldable sufficiently to become small enough to efficiently use available space when folded.

SUMMARY OF THE INVENTION

Accordingly, a primary object of the invention is to provide a baby bed entirely different in structure from conventional beds and foldable into a compact shape by a simple operation.

This invention provides a baby bed including a front frame, a rear frame, a hammock made of a flexible material suspended from the front and rear frames, front and rear legs for supporting the front and rear frames and the hammock, and left and right base blocks adapted to rotatably support the front and rear frames and front and rear legs, respectively.

A front bracket is rotatably attached to at least one side rod portion of the front legs. A rear bracket is rotatably attached to at least one side rod portion of the rear legs. One end of the front bracket and one end of the rear bracket are rotatably connected by a vertically movable guide pin. The other end of the front bracket is rotatably connected by a front link rotatably attached to a longitudinal rod portion of the front frame, while the other end of the rear bracket is rotatably connected to a rear link rotatably attached to a longitudinal rod portion of the rear frame. In the open state of the baby bed the guide pin is prevented from vertical movement by a locking means.

According to the invention of the structure described above, opening and closing operations of the baby bed can be effected very smoothly and easily and the baby bed can be folded into a very compact shape. Stated more specifically, when it is desired to fold the bed, all that is necessary to do is to bring a locking means operated guide pin out of engagement and to depress the front and rear frames. When it is desired to unfold the baby bed, it is only necessary to open the front and rear frames and then lock the guide pin against movement by use of the locking means. Since the hammock is made of a flexible material, it is possible to fold the front and rear frames by moving the frames toward each other, with the result that the bed can be reduced to a sufficiently small size when folded. Preferably, the left and right side rod portions of the front and rear legs are made longer in length than the left and right longitudinal rod portions of front and rear frames, whereby the folded size of the bed can be reduced even further.

These and other objects and features of the invention will become more apparent from the following detailed description of the invention given in conjunction with the accompanying drawings.

DESCRIPTION OF THE PREFERRED EMBODIMENTS AND OF THE BEST MODE OF THE INVENTION

Figure 1:
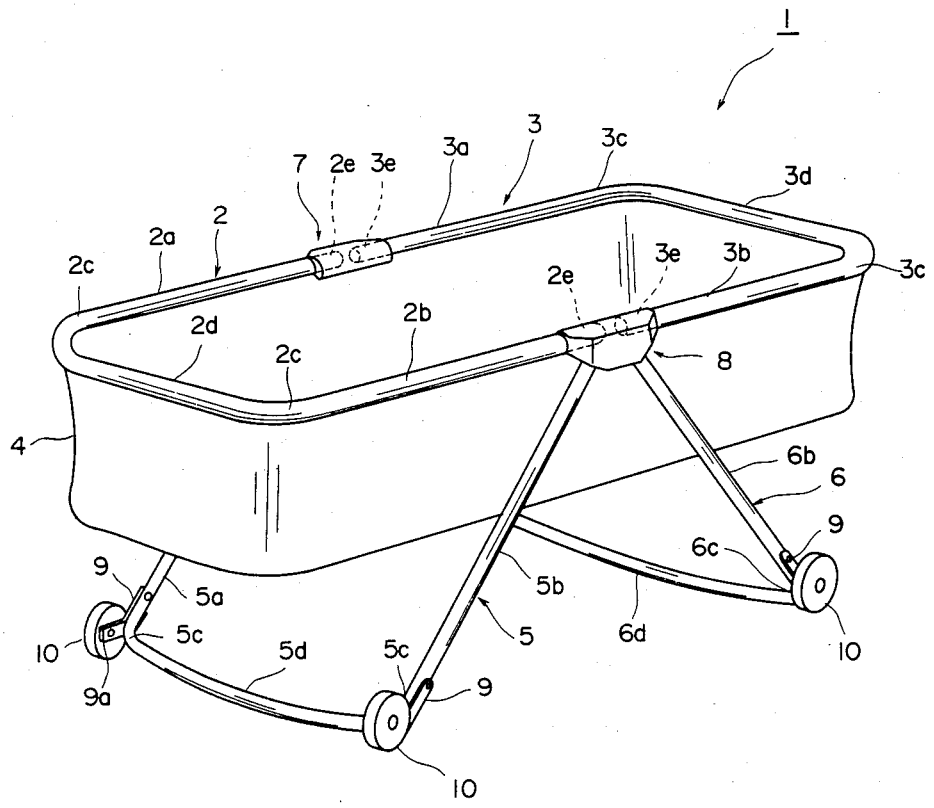
FIG. 1 is a perspective view of the baby bed according to one embodiment of the invention.

FIG. 1 is a perspective view showing one embodiment of a baby bed of the invention in an unfolded state. The baby bed 1 includes a U-shaped front frame 2, a U-shaped rear frame 3, a hammock 4 suspended from the frames 2 and 3, U-shaped front and rear legs 5, 6 for supporting the front and rear frames 2, 3 and the hammock 4, a left base block 7 and a right base block 8 adapted to rotatably support the front and rear frames 2, 3 and the front and rear legs 5, 6 respectively.

The U-shaped front frame 2 comprises a left longitudinal rod portion 2*a*, a right longitudinal rod portion 2*b*, and a lateral side rod portion 2*d* for connecting the respective outer ends 2*c* of the longitudinal rod portions 2*a* and 2*b*. The rear frame 3 comprises a left longitudinal rod portion 3*a*, a right longitudinal rod portion 3*b* and a lateral side rod portion 3*d* for connecting the respective outer ends 3*c* of the rod portions 3*a* and 3*b*. The front frame 2 and rear frame 3 are attached to the left base block 7 and to be right base block 8 such that the respective inner ends 2*e* and 3*e* are opposed to each other.

The hammock 4 is made, for example, of a flexible material, for example woven fabric, knitted fabric, netting plastic material such as a vinyl sheet, or composite materials.

The U-shaped front leg 5 comprises a left side rod portion 5*a*, a right side rod portion 5*b*, and a lower rod portion 5*d* for connecting the respective lower ends 5*c* of the portions 5*a* and 5*b*. The rear leg 6 comprises a left side rod portion 6*a*, a right side rod portion 6*b*, and a lower rod portion 6*d* for connecting the respective lower ends 6*c* of the portions 6*a* and 6*b*. The front leg 5 and rear leg 6 as shown are preferably outwardly curved at their respective lower rod portions 5*d* and 6*d*.

Adjacent to the lower ends of the respective left side rod portions 5*a* and 6*a* and right side rod portions 5*b* and 6*b* of the front leg 5 and rear leg 6 there are pivotally supported substantially L-shaped wheel brackets 9 so as to permit movement of the brackets 9 between upper and lower positions. A wheel 10 is rotatably mounted to the lower portion 9*a* of each of the wheel brackets 9. The size and the arranging position of the wheel bracket are selected to meet the following conditions. Namely, when the brackets 9 are rotated to their upward positions, the respective lower rod portions 5*d* and 6*d* of the front leg 5 and rear leg 6 reach the ground, and when the wheel brackets 9 are rotated to their lower positions, the wheels 10 are adapted to reach the ground. When the wheels 10 are on the ground, the baby bed 1 can be moved back and forth. As described above, the respective lower rod portions 5*d* and 6*d* of the front leg 5 and rear leg 6 are preferably formed outwardly curved. Accordingly, when the lower rod portions 5*d* and 6*d* are on the ground, the baby bed 1 is allowed to rock in the direction of its width so that the bed can be used as a rocking cradle.

As a material used for the front leg 5, rear leg 6, front frame 2, and rear frame 3 there may be mentioned, by way of example, various materials such as plastics or metal. The front leg 5 and rear leg 6 form an inverted V-shape when the baby bed 1 is unfolded whereby the support for the front and rear frames 2 and 3 and hammock 4 is stabilized. Preferably, the left and right side rod portions 5*a*, 5*b* and 6*a*, 6*b* of the front leg 5 and rear leg 6 are longer than the left and right longitudinal rod portions 2*a*, 2*b* and 3*a*, 3*b* of the front frame 2 and rear frame 3 whereby the hammock 4 is positively positioned within the U-shape of the front leg 5 and rear leg 6 when the baby bed 1 is brought into a folded state shown in FIG. 2, so that the volume of the baby bed 1 in the folded state is reduced to a greater degree and also the baby bed 1 becomes more compact in its folded state.

Figure 2:
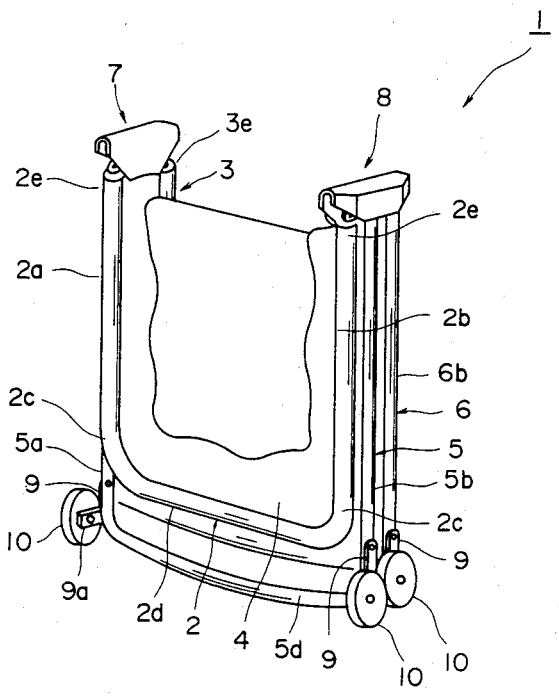
FIG. 2 is a perspective view of the baby bed shown in FIG. 1 when folded.

Also, as shown in FIG. 2, even if the baby bed 1 is in a folded state, four wheels 10, when in their lower positions, reach the ground on substantially the same level and at a certain spacing from each other, so that the baby bed 1 is allowed not only to stand independently but also to be moved back and forth if necessary.

Figure 3:
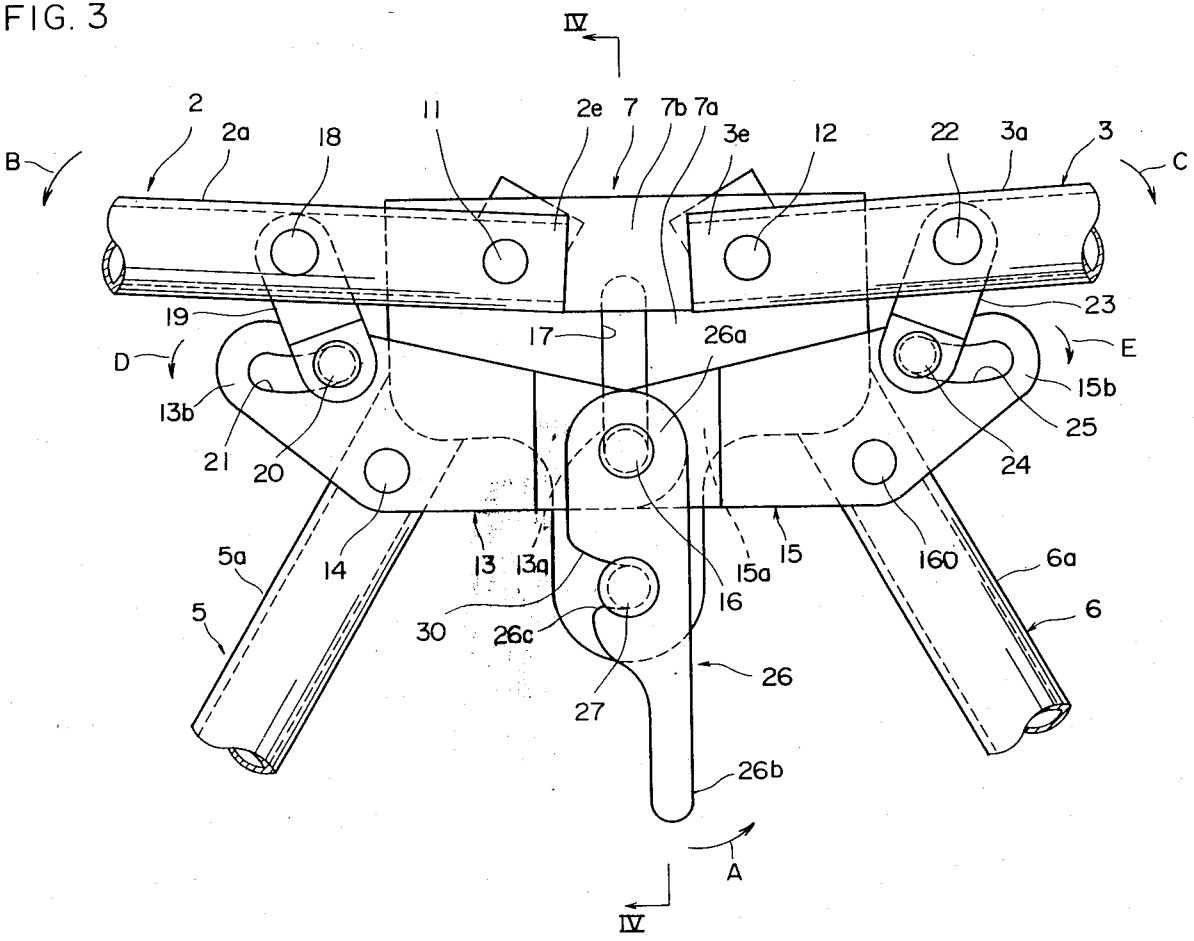
FIG. 3 is a front view showing the base block portion of the baby bed in FIG. 1 and showing the relation between the front and rear frames and the front and rear legs respectively connected to the base block.

How the front leg 5, rear leg 6, front frame 2, and rear frame 3 are connected to the left base block 7 and right base block 8 will be now described with reference to FIGS. 3 and 4. FIG. 3 is a front view showing a portion of the left base block 7 and FIG. 4 is a sectional view taken along the line IV—IV of FIG. 3.

Figure 4:
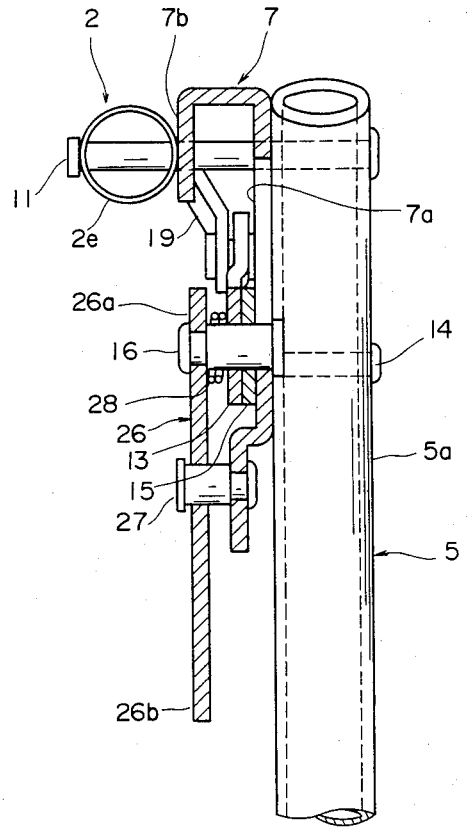
FIG. 4 is a sectional view taken along the line IV—IV of FIG. 3.

The left base block 7 has a platelike main planar portion 7*a* and a bent-up portion 7*b* formed by bending an upper end of the portion 7*a* inwardly of the baby bed and then bending the end downwardly for forming the sectional configuration shown in FIG. 4. The inner end 2*e* of the left longitudinal rod portion 2*a* of the front frame 2 and the upper end of the left side rod portion 5*a* of the front leg 5 are rotatably connected to the bent-up portion 7*b* of the left base block 7 by a rotary pin 11. The inner end 3*e* of the left longitudinal rod portion 3*a* of the rear frame 3 and the upper end of the left side rod portion 6*a* of the rear leg 6 are rotatably connected to the bent-up portion 7*b* of the left base block 7 by a rotary pin 12.

A substantially triangular front bracket 13 is rotatably mounted adjacent to the upper end of the left side rod portion 5*a* of the front leg 5 by a rotary pin 14. A substantially triangular rear bracket 15 is rotatably mounted adjacent to the upper end of the left side rod portion 6*a* of the rear leg 6 by a rotary pin 160. One end portion 13*a* of the front bracket 13 and one end portion 15*a* of the rear bracket 15 are rotatably connected to each other by a vertically movable guide pin 16. A vertically long guide slot 17 is formed in the middle of the left base block 7 for receiving the guide pin 16 therein and guiding the vertical movement of the guide pin 16 along the slot 17. Accordingly, the guide pin 16 is allowed to travel vertically along a stabilized and accurate path. As is apparent from FIG. 3, when the guide pin 16 is moved further upwardly from the position in which the guide pin 16 is shown, the front leg 5 and rear leg 6 make symmetrical movements and are respectively rotated around the rotary pins 11 and 12. Preferably, the end of upward movement of the guide pin 16 is limited by the upper end portion of the guide slot 17, while the end of downward movement of the guide pin 16 is limited by the lower end portion of the guide slot 17.

A front link 19 is rotatably mounted adjacent to the inner end 2*e* of the left longitudinal rod portion 2*a* of the front frame 2 by a rotary pin 18. The other end portion 13*b* of the front bracket 13 is rotatably connected to the front link 19, preferably in the following manner, namely, an outwardly facing engaging pin 20 is attached to the front link 19, while a slot 21 is formed at the other end portion 13*b* of the front bracket 13 for receiving the engaging pin 20 therein and permitting the movement of the engaging pin 20 along the slot 21. In this manner, the front link 19 is connected to the other end portion 13*b* of the front bracket 13 by engagement of the engaging pin 20 in the slot 21.

The rear link 23 is rotatably attached to the left longitudinal rod portion 3*a* of the rear frame 3 through a rotary pin 22. The other end portion 15*b* of the rear bracket 15 is rotatably connected to the rear link 23 in the following manner. Namely, the outwardly facing engaging pin 24 is attached to the rear link 23, while a slot 25 is formed at the other end portion 15*b* of the rear bracket 15 for receiving the engaging pin 24 therein and for permitting the movement of the engaging pin 24. In this manner, the rear link 23 is connected to the other end portion 15*b* of the rear bracket 15 by the engagement of the engaging pin 24 in the slot 25.

A guide pin 16 for rotatably connecting one end portion 15*a* of the rear bracket 15 to one end portion 13*a* of the front bracket 13, is vertically movable as described above, but is prevented from vertical movement by a locking means. One example of the locking means will be described below. As shown in FIG. 3, the upper portion 26*a* of a handle 26 is rotatably connected to the guide pin 16. The lower portion 26*b* of the handle 26 is adapted to provide a grip when the handle 26 is turned about the guide pin 16. The handle 26 is formed with a locking recess 26*c*. An engaging pin 27 is fixed to the left base block 7. The pin 27 engages in the locking recess 26*c* when the guide pin 16 is in a specified position and when the handle 26 is rotated into the specified position. Preferably, when the guide pin 16 is positioned at the lower end portion of the guide slot 17 formed in the left base block 7, the engaging pin 27 is adapted to be engageable in the locking recess 26*c*. More preferably, a kick spring 28 is disposed around the guide pin 16 positioned between the handle 26 and the front bracket 13 so as to normally urge the handle 26 to turn clockwise in FIG. 3.

In the state shown in FIG. 3, the guide pin 16 is prevented from upward movement. Accordingly, the front bracket 13 and rear bracket 15 each are prevented from moving around the guide pin 16, with the result that movement of the front leg 5 and rear leg 6 respectively around the rotary pins 11 and 12 is also prevented. And the front frame 2 connected through the front link 19 to the front bracket 13 is also prevented from moving around the rotary pin 11. In like manner, the rear frame 3 connected through the rear link 23 to the rear bracket 15 is also prevented from moving around the rotary pin 12.

The slot 21 at the other end portion 13*b* of the front bracket 13, when the front bracket 13 is in a fixed state as shown in FIG. 3, is preferably formed to extend along the curve of rotation of an engaging pin 20 around a rotary pin 18. By so doing, the front frame 2 is supported always on the same level with respect to the front bracket 13 in whatever position of the slot 21 the engaging pin 20 may be. The same is the case also with the slot 25 formed at the other end portion of the rear bracket 15. In this manner, when the guide pin 16 is prevented from vertical movement by locking means, the baby bed is locked in its unfolded state as shown in FIGS. 1 and 3.

Next, the folding of the baby bed will be described.

Figure 5:
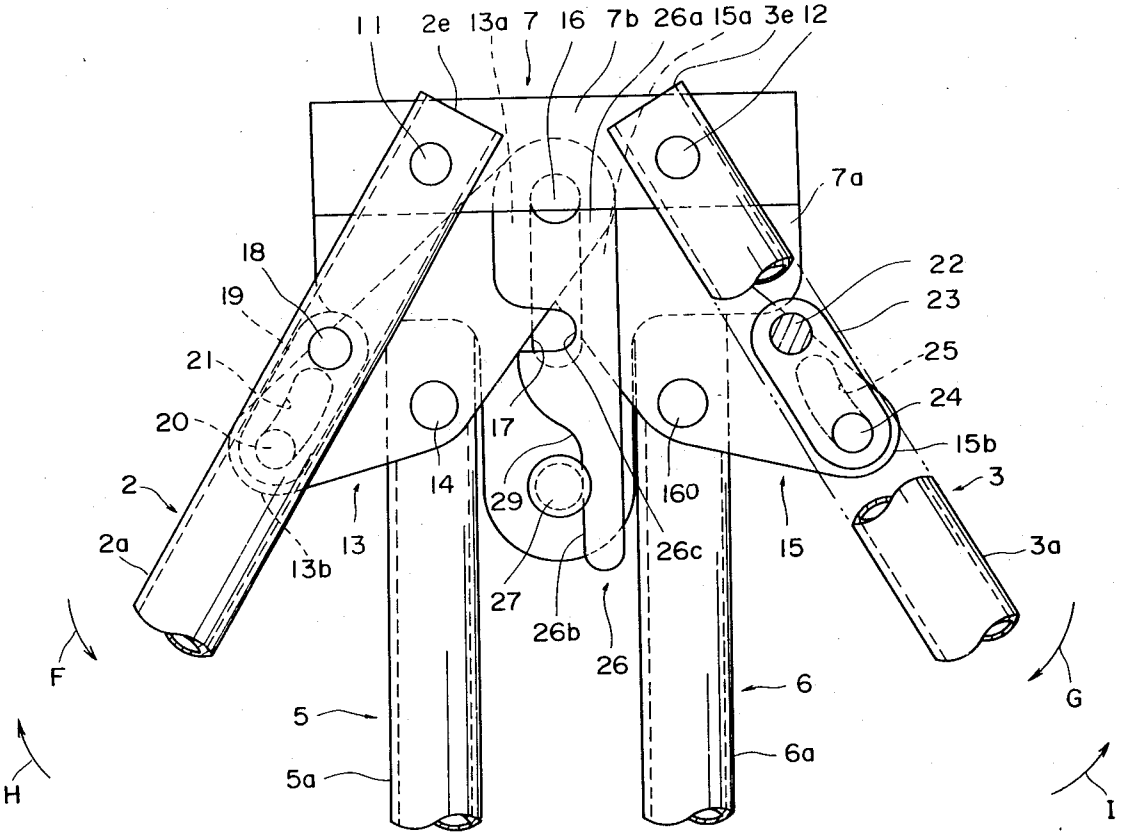
FIG. 5 is a view corresponding to FIG. 3 but showing the base block portion when the folding is half completed.

When it is desired to change the baby bed 1 from an unfolded state shown in FIG. 1 to a folded state shown in FIG. 2, the handle 26 shown in FIG. 3 is moved in the direction indicated by an arrow A by the grip 26*b* of the handle 26. Thereupon, the engaging pin 27 is brought out of engagement in the locking recess 26*c* of the handle 26, and a guide pin 16 is allowed to move upwardly. Accordingly, when the front frame 2 and rear frame 3 are depressed respectively in arrow-indicated directions B and C, the front bracket 13 and rear bracket 15 connected respectively to the front frame 2 and rear frame 3 through a front link 19 and rear link 23 are moved in arrow-indicated directions D and E. When the front frame 2 and the rear frame 3 are depressed further downwardly, the front bracket 13 and the rear bracket 15 are rotated to the position in which the guide pin 16 is prevented from upward movement by the upper end of the guide slot 17 as shown in FIG. 5. Along with this rotation, the front leg 5 and the rear leg 6 are respectively rotated about rotary pins 11 and 12 and are brought into a substantially upright state (closed state) and stopped from rotating as shown in FIG. 5.

Figure 6:
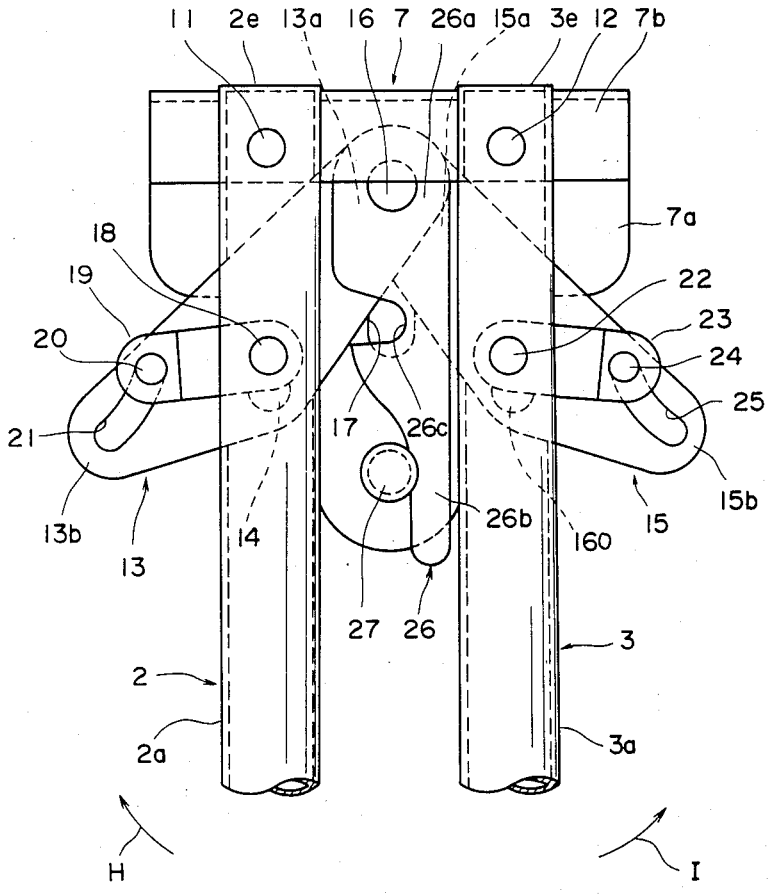
FIG. 6 is likewise a view corresponding to FIG. 3 but showing the base block portion when the folding is completed.

The described folding operation of the front bracket 13, rear bracket 15, front leg 5 and rear leg 6 is stopped when the front frame 2 and rear frame 3 are brought into the position shown in FIG. 5. In the position shown, the engaging pin 20 provided in a front link 19 is moved onto the outer end (lowermost position in FIG. 5) of the slot 21 formed in the front bracket 13 and likewise an engaging pin 24 provided in the rear link 23 is moved to the outer end of the slot 25 formed in the rear bracket 15. As described above, slots 21 and 25 are formed long so as to permit movement of the engaging pins 20 and 24. Accordingly, the front frame 2 and rear frame 3 are moved respectively in the directions indicated by arrows F and G to their final closed positions. Namely, when the front frame 2 is caused to move further around rotary pin 11 in the arrow-indicated direction F, the front link 19 is moved clockwise and the engaging pin 20 is moved upwardly in the slot 21 along with the movement of the clockwise movement of the front link 19. The end of upward movement of the engaging pin 20 is limited by the inner end (the upward end position in FIG. 5) of the slot 21 in such a state as shown in FIG. 6. As shown, the front frame 2 is moved from the state shown in FIG. 5 further to a substantially upright state (closed to its utmost degree) in which the rotation of the front frame 2 is stopped. Since the relation between the rear frame 3 and the rear link 23 is also entirely the same, a description thereof is omitted.

In this manner, the baby bed can be folded from the open state shown in FIG. 1 to the closed state in FIG. 2 by a very simple operation.

Opening the bed from the closed state in FIG. 2 to the open state in FIG. 1 will now be described. In this case, it is only necessary to move the front frame 2 and rear frame 3 respectively in the directions indicated by arrows H and I in FIG. 6. Along with the movement of the front frame 2 in the direction indicated by arrow H, the front link 19 is moved counterclockwise in FIG. 6, and the engaging pin 20 is moved toward the outer end inside the slot 21. Likewise, the rear link 23 is moved clockwise in FIG. 6 and the engaging pin 24 is moved toward the outer end inside the slot 25. In this manner, the state shown in FIG. 5 is brought about.

When the front frame 2 and the rear frame 3 are moved respectively in the directions indicated by arrows H and I, the front bracket 13 is moved clockwise in FIG. 5 and the rear bracket 15 is moved counterclockwise. Along with the movement of both brackets 13 and 15, the guide pin 16 connecting the two brackets is moved downwardly along its guide slot 17. The handle 26 is urged to normally move clockwise by the action of a kick spring 28. Preferably, the handle 26 is formed such that a portion 29 in contact with the engaging pin 27 describes a smooth curve as shown. Accordingly, along with the downward movement of the guide pin 16, the handle 26 is moved counterclockwise by bringing the curved portion 29 of the handle 26 into contact with the engaging pin 27. When the guide pin 16 has reached the lower end of the guide slot 17, the engaging pin 27 reaches the position in which the pin 27 is allowed to engage the locking recess 26*c* of the handle 26. Due to the action of the kick spring 28, the engaging pin 27 is brought into engagement with the locking recess 26*c* without touching the handle 26 at all. Engagement of the pin 27 in the recess 26*c* is firmly maintained by the action of the kick spring 28. In this manner, the open state of the baby bed shown in FIG. 3 is locked.

The handle 26 used in the embodiment illustrated above is formed such that as shown in FIG. 3, the upward side 30 limiting the locking recess 26*c* is slightly rounded. Accordingly, when the handle 26 is rotated, the engaging pin 27 is allowed to be readily moved into and out of engagement in the recess 26*c*. But the handle 26 may be modified into the shape shown in FIG. 7.

Figure 7:
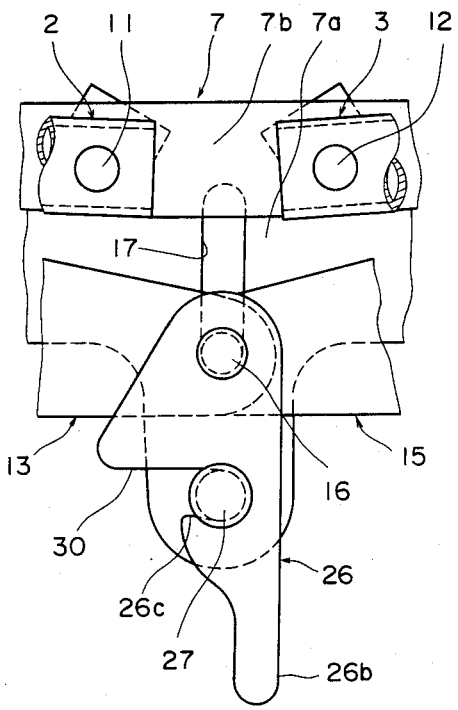
FIG. 7 is a front view of the base block portion which shows, in comparison with the base block portion in FIG. 3, a modification of a handle used for the prevention of vertical movement of a guide pin.

In the case of the handle 26 shown in FIG. 7, the upward side 30 limiting the locking recess 26*c* is formed to extend horizontally, as shown, when the engaging pin 27 engages the locking recess 26*c*. Accordingly, when the handle 26 is rotated counterclockwise in FIG. 7, the engaging pin 27 continues to remain in contact with the upward side 30 for a while, thereby permitting the guide pin 16 to travel upwardly along the guide slot 17. In this manner, since the handle 26 is moved upwardly along with the rotation of the handle 26, the handle 26 is prevented from moving and returning to the state of the handle 26 coming into engagement with the engaging pin 27. Accordingly, when in the folding operation the handle 26 is rotated counterclockwise by one hand, then the hand is let off, and the front frame 2 and rear frame 3 are rotated downwardly to fold the bed, the state which would be brought about in the case of the handle 26 having the shape shown in FIG. 3, namely the state in which, because the hand is let off, the handle 26 is rotated and returned to come into engagement again with the engaging pin 27 would be prevented. And if the handle 26 is rotated and the guide pin 16 is moved upwardly while the pin 27 is being maintained in contact with the upward side 30 extending horizontally long, then the whole of the baby bed is moved in the direction in which it is folded, with the result that folding operation is slightly facilitated and the folding movement becomes smooth.

In the embodiment illustrated, although the brackets 13, 15 links 19, 23 and handle 26 are provided on the left base block 7 side alone, it should be understood that they may be provided only on the right base block, or both on the left and right side blocks. And in the embodiment illustrated, the kick spring 28 for urging the handle 26 to normally rotate clockwise is provided, but such spring 28 is not always necessary.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. A baby bed comprising:

a front frame (2) having left and right longitudinal rod portions (2*a*, 2*b*) and a lateral rod portion (2*d*) for connecting the outer ends (2*c*) of both said longitudinal rod portions (2*a*, 2*b*), a rear frame (3) having left and right longitudinal rod portions (3*a*, 3*b*) and a lateral rod portion (3*d*) for connecting the outer ends (3*c*) of both said longitudinal rod portions (3*a*, 3*b*) and having the inner ends (3*e*) of both said longitudinal rod portions (3*a*, 3*b*) disposed in opposed relation with the inner ends (2*e*) of both said longitudinal rod portions (2*a*, 2*b*) of said front frame (2), a hammock (4) made of a flexible material and suspended from said front and rear frames (2, 3), front and rear legs (5, 6) adapted to support said front and rear frames (2, 3) and said hammock (4) and having left and right side rod portions (5*a*, 5*b*, 6*a*, 6*b*) and lower rod portions (5*d*, 6*d*) for connecting the lower ends (5*c*, 6*c*) of both said side rod portions (5*a*, 5*b*, 6*a*, 6*b*), a left base block (7) for rotatably supporting an inner end (2*e*) of the left longitudinal rod portion (2*a*) of said front frame (2), an inner end (3*e*) of the left longitudinal rod portion (3*a*) of said rear frame (3), an upper end of the left side rod portion (5*a*) of said front leg (5), and an upper end of said left side rod portion (6*a*) of said rear leg (6), respectively, a right base block (8) for rotatably supporting an inner end (2*e*) of the right longitudinal rod portion (2*b*) of said front frame (2), an inner end (3*e*) of the right longitudinal rod portion (3*b*) of said rear frame (3), an upper end of the right side rod portion (5*b*) of said front leg (5), and an upper end of the right side rod portion (6*b*) of said rear leg (6), respectively;

at least one of said base blocks (7, 8) comprising a vertically extending elongated guide slot (17), a front bracket (13) rotatably connected to at least one side portion (5*a* or 5*b*) of said front leg (5), a rear bracket (15) rotatably connected to at least one side portion (6*a* or 6*b*) of said rear leg (6), a vertically movable guide pin (16) rotatably interconnecting one end portion (13*a*) of said front bracket (13) and one end portion (15*a*) of said rear bracket (15), said vertically movable guide pin (16) being guided for vertical up and down movement in said elongated guide slot, a front link (19) rotatably attached to said longitudinal rod portion (2*a*) of said front frame (2) and rotatably connected to another end portion (13*b*) of said front bracket, a rear link (23) rotatably attached to the longitudinal rod portion (3*a*) of said rear frame (3) and rotatably connected to another end portion (15*b*) of said rear bracket (15), and locking means (26*c*, 27) operatively arranged for cooperation with said guide pin (16) for preventing an upward and downward movement of said guide pin (16) when said baby bed is open.

2. The baby bed of claim 1, wherein the terminal end of upward movement of said guide pin (16) is regulated by the upper end portion of said guide slot (17), and the terminal end of downward movement of said guide pin (16) is regulated by the lower end portion of said guide slot (17).

3. The baby bed of claim 1, wherein said guide pin (16) has a handle (26) rotatably connected thereto, wherein said locking means comprise a locking recess (26*c*) in said handle, said locking means further comprising an engaging pin (27) operatively secured to at least one of said left and right base blocks (7, 8), said engaging pin (27) being adapted to engage in said locking recess (26*c*) when said guide pin (16) is in a specified position and when said handle (26) is rotated into said position.

4. The baby bed of claim 3, further comprising a spring (28) operatively arranged for urging said handle (26) to normally rotate in the direction in which said engaging pin (27) is brought into engagement in said locking recess (26*c*).

5. The baby bed of claim 3, wherein said handle (26) has an upper edge (30) for limiting said locking recess (26*c*) in said handle (26), said edge (30) extending longitudinally and horizontally when said engaging pin (27) is engaged in said locking recess (26*c*).

6. The baby bed of claim 1, wherein said front link and rear link (19, 23) comprise engaging pins (20, 24) attached thereto, said front and rear brackets (13, 15) comprising slots (21, 25) for receiving therein said engaging pins (20, 24) for permitting movement of the pins (20, 24) in said slots (21, 25), and wherein said front and rear links (19, 23) are connected to the other end portions (13*b*, 15*b*) of said front and rear brackets (13, 15) by engagement of said engaging pins (20, 24) in said slots (21, 25).

7. The baby bed of claim 1, wherein the lengths of the left and right side portions (5*a*, 5*b*, 6*a*, 6*b*) of said front and rear legs (5, 6) are longer than the lengths of the left and right longitudinal rod portions (2*a*, 2*b*, 3*a*, 3*b*) of said front and rear frames (2, 3).

8. The baby bed of claim 1, wherein the lower rod portions (5*d*, 6*d*) of said front and rear legs (5, 6) are formed outwardly curved.

9. The baby bed of claim 1, further comprising wheels and bracket means for rotatably mounting said wheels to the left and right side rod portions (5*a*, 5*b*, 6*a*, 6*b*) of said front and rear legs (5, 6), whereby said wheels (10) are movable between upper and lower positions, whereby the lower rod portions (5*d*, 6*d*) of said front and rear legs (5, 6) reach the ground when said wheels (10) are in their upper position, and said front wheels (10) reach the ground when the wheels (10) are in their lower position.

* * * * *